United States Patent [19]

Cook

[11] Patent Number: 4,541,210

[45] Date of Patent: Sep. 17, 1985

[54] MULTIPLE RISE COVER

[75] Inventor: Lynn W. Cook, Fruit Heights, Utah

[73] Assignee: Envirotech Corporation, Salt Lake, Utah

[21] Appl. No.: 507,429

[22] Filed: Jun. 23, 1983

[51] Int. Cl.[4] ..... E04B 7/06

[52] U.S. Cl. ..... 52/82; 52/80; 52/745

[58] Field of Search ..... 52/82, 80, 73, 83, 222, 52/745

[56] References Cited

U.S. PATENT DOCUMENTS

| | | | |
|---|---|---|---|
| 2,670,818 | 2/1954 | Hacker | 52/82 X |
| 3,130,488 | 4/1964 | Lindstrom | 52/82 X |
| 3,153,303 | 10/1964 | Wheeler | 52/73 |
| 3,281,999 | 11/1966 | Keely | 52/82 |

FOREIGN PATENT DOCUMENTS

| | | | |
|---|---|---|---|
| 611172 | 12/1960 | Canada | 52/80 |
| 2212892 | 11/1972 | Fed. Rep. of Germany | 52/80 |
| 2025470 | 2/1980 | Fed. Rep. of Germany | 52/82 |
| 474528 | 9/1952 | Italy | 52/82 |
| 548146 | 9/1956 | Italy | 52/80 |
| 566991 | 9/1957 | Italy | 52/80 |
| 71984 | 3/1953 | Netherlands | 52/80 |
| 212801 | 5/1967 | Sweden | 52/80 |
| 590294 | 7/1947 | United Kingdom | 52/82 |

*Primary Examiner*—Donald G. Kelly
*Assistant Examiner*—Richard E. Chilcot, Jr.
*Attorney, Agent, or Firm*—Thomas S. McDonald; Alan H. MacPherson; Carl Rowald

[57] ABSTRACT

A cover and erection method for a tank, sedimentation device or building cover constructed over or within a generally continuous upstanding circular side wall (30), made up of a series of concentric spaced thrust rings (11, 12, 21) having multiple short curved radial beams (14, 19) bridging the annuli between the rings and cover plates (17, 21) extending across the spaces between adjacent ones of the beams between each of the spaced rings. Erection may be from the wall inwardly or from the center to the wall. In either event an intermediate thrust ring is temporarily supported at an elevation above and within the side wall and the beams set across the rings in relatively short radial spans prior to welding of beams and plates to the respective rings. By this technique, small lightweight beams can be utilized for building large-diameter covers or domes with each rise span being of relatively small length. Each rise may be designed in terms of beam and plate size independently of the beam and plate size used in the previous rise. In one embodiment where the radius of curvature of any rise differs from that of other rises providing for unusual geometric requirements or providing for less stress on the cover plates.

20 Claims, 4 Drawing Figures

MULTIPLE RISE COVER

BACKGROUND OF THE INVENTION

This invention relates to an improved domed cover and method of construction therefor wherein the cover is used to cover a tank such as a digester or sedimentation tank or a building. The invention finds particular utility with respect to covers which must span a distance between tank or building walls of approximately at least fifty feet in diameter.

FIELD OF THE INVENTION

The invention is directed to a dome-type roof or cover for a structure such as storage tanks, tanks for digesters, clarifiers or thickeners, or for buildings, wherein a fixed or vertically floating roof or cover is constructed essentially within or on continuous side walls of the structure, without support from interior columns or massive girder or truss constructions.

PRIOR ART

Heretofore, domes and roofs spanning a large diameter wall of a structure have been constructed generally by either providing expensive false work within the structure whereby a concrete dome may be poured in place or massive girder/truss work provided to bridge the span and support a cover affixed to the top of the work. In many instances such latter construction requires structural interior columns to support the trusswork and cover. Suspension roofs have also been utilized where a center column support is provided at the center of the structure and tension wires or rods affixed radially between the column and surrounding structure walls. Typical of such concrete constructions are those seen in U.S. Pat. No. 3,427,777 in which precast segments of concrete are raised in place to a grid of temporary support segments and passages between the concrete segments filled in with concrete to form segment-connecting ribs. The support segments are then removed after the concrete ribs have been "set". U.S. Pat. Nos. 2,849,792 and 3,449,884 illustrate the use of tension bars or wires supported by a center column and on which metal roof segments are affixed. U.S. Pat. No. 1,570,311 shows metal roofing for covering circular buildings or tanks supported from a series of circular girders by means of radial beams supported at intervals by internal uprights symmetrically arranged about a center post.

Dome-like section covers for digesters have been constructed in the past by Eimco Process Machinery/Envirotech Corporation, in which lengthy radial compression beams span the entire distance between a thrust ring on the outer digester continuous wall to a center compression ring which is temporarily supported at the center of the tank by false work. As the tank diameters increase, the cross-sectional size and strength of the beams must be increased to compensate for the increasing spans and loading from the cover plates. In such construction the entire cover is erected as a single item. On larger diameter tanks, straight cross beams were erected between the lengthy radial compression span beams and short radial beams placed between the thrust ring and the cross beams. Essentially trapezoidal cover plates were then welded on the constructed framework extending over the entire tank top.

SUMMARY OF THE INVENTION

The present invention is direct to a construction which eliminates the large beams of the prior art and does not utilize either centrally-supported tension members or any form of permanent central or interior supports.

The improved construction utilizes one or more intermediate thrust rings extending concentrically between a thrust ring at the continuous outer wall of the structure and a center thrust ring so that the cover or dome can be built outwardly from or inwardly toward the center in a series of rises of relatively small span while being temporarily supported from underneath.

In the preferred method of construction, a first thrust ring is provided adjacent to the top of the structure continuous wall with an intermediate concentric ring temporarily supported by scaffolding or the like in spaced position inboard of the first thrust ring to form an annular section between the two rings. Short radial beams are then connected at various positions across the annulus between the thrust ring and intermediate ring and welded to support brackets extending from the intermediate ring to form a set of radial beams, like spokes between a hub and wheel. Pie-shaped or slightly trapezoidal-shaped cover plates are then one-by-one placed and welded between the thrust ring and intermediate ring between each of two of the set of radial beams. This forms the first rise, i.e., an outer rise, of the cover. A second set of radial beams are then welded to the inner side of the intermediate ring bridging the annulus to a second intermediate thrust ring located inboard of the first intermediate thrust ring and plate segments welded thereover to complete the second rise, i.e., an intermediate rise, of the cover. Similar rises are erected radially inward as required by tank size with the final, inner, rise bridging the annulus between the innermost intermediate ring and the center ring. Temporary scaffolding as required is used to support the structures as it is built inwardly.

Beam size is only dependent on the distance between the intermediate ring(s) and the wall thrust ring and center thrust ring and is thus independent of overall cover size. This is a great advantage in covers of about sixty feet or larger in diameter and such advantage becomes greater and greater as the cover size becomes larger and larger.

The radius of curvature of each rise can be varied within each annular space in either radial direction from the sides of the intermediate thrust ring(s). This is particularly useful when a large load such as a clarifier drive mechanism is to be placed on the top of the center ring to drive rakes contained in the clarifier tank. By decreasing the radius of the inner rise, stresses in the cover can be reduced many-fold since the cover can support the center load at a center area which is not as flat as it would be if a larger curvature was used. The construction lends itself very well for standardization of spans and covers. For example, a standard 50-foot diameter cover can be used as the inner portion of a 100-foot diameter cover.

The improved construction results in appreciable savings in steel weight and expense for the overall cover. For example, a heavy thickener drive mechanism of 45,000 pounds may be supported at the center of a 135-foot diameter cover using 3/16" steel plate. Use of conventional design would have stressed the plate to 215,000 psi, or almost 10 times the allowable. By changing the radius of curvature of the inner rise from 270 feet to 70 feet, the stress was reduced to 11,530 psi which is only about one half the allowable stress.

The improved roof/cover of this invention requires no permanent central or other internal upstanding supports or tension members. It shortens each radial span so that standard beams of small cross-section and weight may be employed eliminating heavy long radial beams and provides a cover, each concentric annular section of which can be designed independently to optimize the economy of the beams and cover plates used for that section.

The invention imposes no radial loads on the structure wall and can accommodate a relative large (1½") lateral and radial displacement of beams and rings with respect to anchor bolts, if used, with no modification needed to the cover segments, essentially eliminating field fit-up problems.

DETAILED DESCRIPTION

Figure 1:
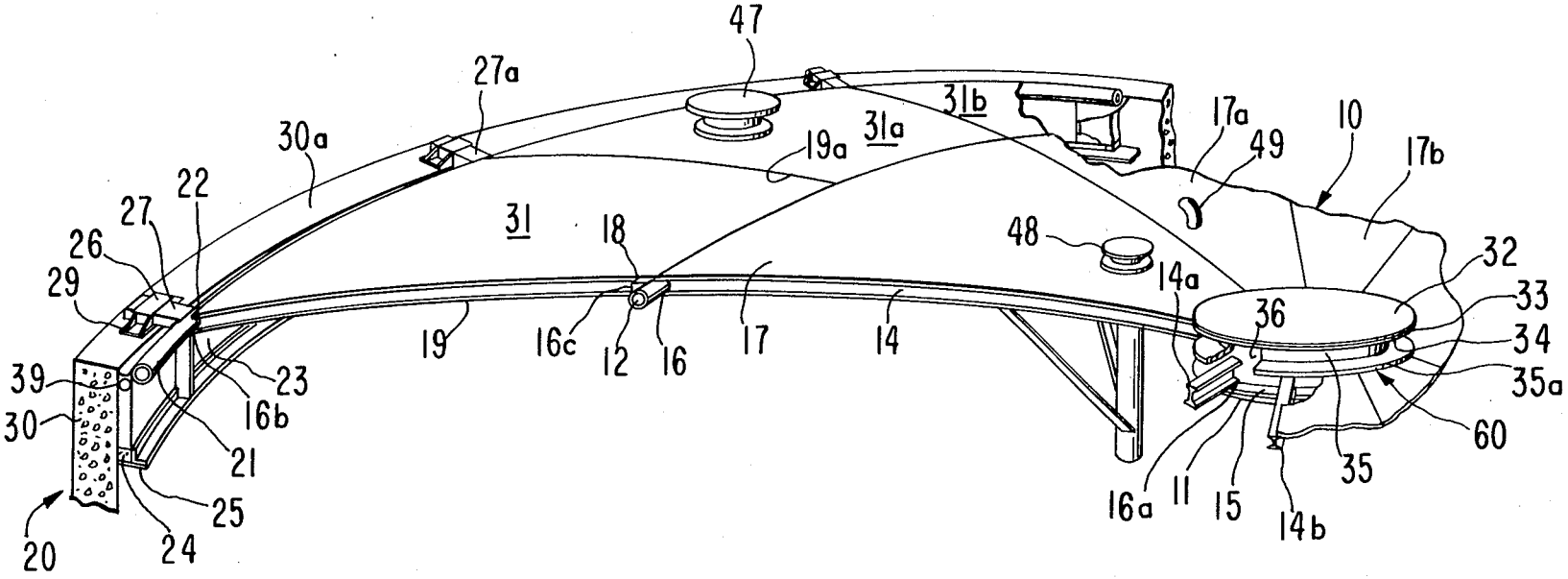
FIG. 1 is a perspective cutaway view of a partial segment of the cover.
Figure 2:
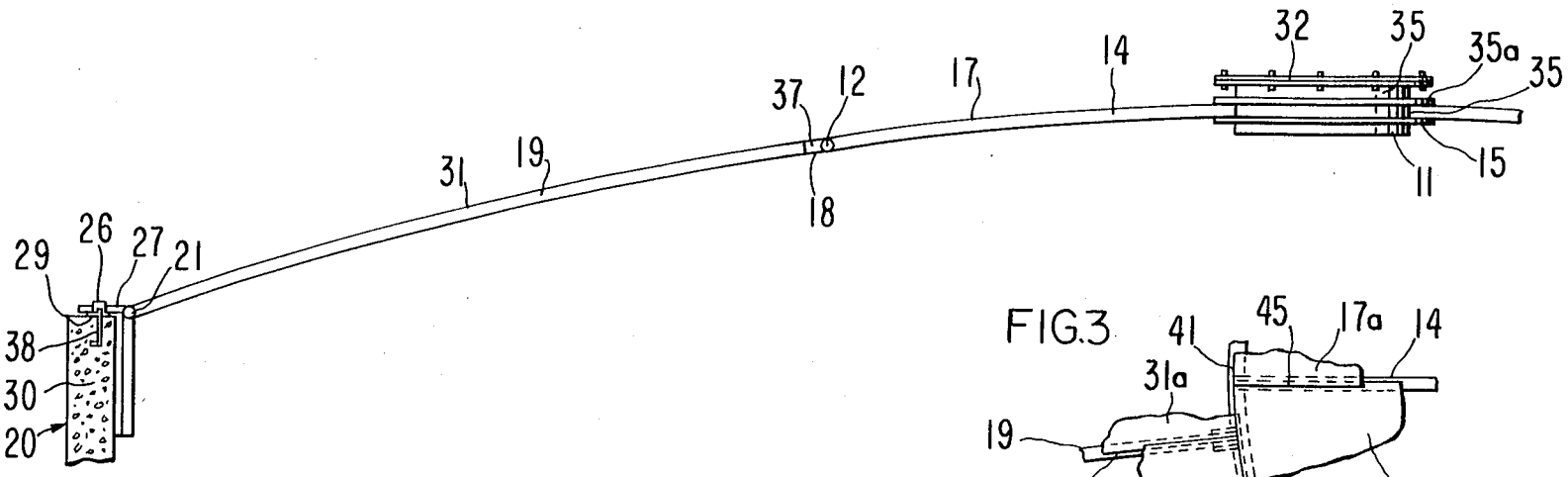
FIG. 2 is a side cross-sectional view of the center ring and one-half of the cover.

Referring to FIG. 1, a partial segment of an overall cover 10 is shown mounted between a tank wall structure 20 and a center ring structure 60. A first thrust ring 21 is connected to the top 30*a* of an upstanding continuous tank wall 30 forming the tank side walls. A concrete tank bottom (not shown) is normally utilized. Connection is by means of a mounting plate 29 bolted to anchor bolts 38 (FIG. 2). A ring support tube 27 extends from mounting plate 29 and is strapped down in final position with respect to the mounting plate by strap 26. Tube 27 serves as a template for mounting the ring and as seen is adjustable radially to compensate for the actual outside diameter of ring 21. Tube 27 is curved at its inner edge to conform to the thrust tube radius. A cover side skirt 23 is erected either outside or inside tank wall 30. If erected inside the wall, it is supported by tube 27. If erected outside the wall, it is placed inside the wall after erection supported by tubes 27. Ring 21 is made up of arcuate sections which are spliced together using bevelled ends and welded together using weld rings while maintaining full strength of the overall thrust ring. Typically, rings 11 and 12 are made of steel with arcuate section length of 15 to 20 feet for ease of handling.

The intermediate thrust ring 12 is concentrically spaced inwardly from thrust ring 21 and spaced to form a circular annulus which is to form the outer cover rise. The outer cover rise is formed by extending a set of relatively short radial beams 19, 19*a*, etc., from around the periphery of the thrust ring structure, more particularly from a thrust ring 21, to the outer-facing beam supports 18 of intermediate thrust ring 12. During this assembly step the intermediate thrust ring 12 is temporarily supported by falsework such as scaffolding extending upwardly from the tank base (not shown) at a prescribed elevation above the base. The thrust ring 21 is centered in the tank at its prescribed elevation and the intermediate thrust ring 12 assembled on its temporary support at its elevation. Segments of the intermediate thrust ring are joined by splicing bevelled ends of the segments and welding them together using weld rings, maintaining full strength in the completed ring.

Radial beams 19, 19*a*, etc., are set in place on the thrust ring 21 and extend to intermediate ring 12 bridging the annulus therebetween. Tack welds are made at the end of each beam as at 16*b* and 16*c*. No bolted connections are required. After all beams 19 are in place the outer ends are completely welded to the thrust ring pipe at 16*b* and the inner ends of the I-beam radial beam completely welded to the intermediate thrust ring beams supports 18.

The outer rise is completed by placing cover plates 31, 31*a*, 31*b*, etc., over the spaces between the thrust ring 21, the intermediate thrust ring and adjacent ones of the set of radial beams, for example, between beams 19 and 19*a*. Cover plates are tack welded in place to prevent cover warpage when final seal welds are made, preferably by semi- or fully-automatic welding. Cover plates are shipped to the jobsite cut to the proper size and shape and no field trimming is required.

The next step is to install a set of inner radial beams 14 between the intermediate ring 12 and the center ring structure 60. A beam support flange 15 provides a holding surface to support the inner ends of inner beams 14 prior to tack welding of both ends of the inner beams to their respective rings. The quantity of inner radial beams 14 used for the inner rise is independent of the quantity of outer radial beams 19 used for the outer rise.

After all inner radial beams are tack welded in place the outer ends are completely welded to the intermediate ring 12 and the inner ends completely welded to support flange 15 on center ring 60. All remaining scaffolding can then be removed since the cover or roof is self-supporting.

In an alternate erection mode the center barrel ring, intermediate thrust ring, radial beams and cover plates may be ground assembled adjacent to the tank and then that assembly hoisted as a completed inner rise section to the center portion of the tank at a proper elevation and then temporarily supported by scaffolding or columns. The outer rise is then erected as described above.

Cover plates 17 for the inner rise annulus are then installed between the respective rings 12 and 60 and adjacent ones of the second set of short radial beams, tacked in place to prevent warpage and seal welds made. Plates between adjacent spaces are overlapped to help form a water-tight cover. While the plates may be butted, such necessitates more accurate fitting and assembly. Steel plates of 3/16" and ¼" thickness are typically employed.

A center adapter ring 35 having a flange 35*a* is then positioned over the side wall 11 of center barrel 36 and seal welded to the barrel 36 and the top inner extremity of plates 17, 17*a*, 17*b*, etc. A center ring flange 34, Neoprene gasket 33 and center ring cover 32 are then bolted to adapter ring 35. Apertures are then field cut in the cover for any desired tank cover entry such as a manhole 47, sample tube 48 or gas take-off 49.

The tank cover installation is completed by providing a mastic, asphalt or oakum cover sealant 24, 39 in the annulus between concrete or other wall 30 and skirt 23. It is sealed by plate 25 welded to an angle at the bottom of the side skirt 23.

The short span, i.e., from 10 to 20 feet, of the radial beams in the inner and outer rises allows use of standard 3" high I-beams having a weight of 7.5 lbs/ft. to support the single span cover. In the prior art the entire cover geometry was dictated by the length of the single span beams. As covers of 120-foot diameter and greater were required, the single beam weight and size became impractical.

In an alternative mode of erection the cover of this invention may be built outwardly from center ring 60 with the inner rise first assembled, scaffolding removed from under the center ring 60 and the lower rise assembled and scaffolding removed. This is the preferred mode of erection when only two rises are to be constructed.

While the invention has been described in terms of a circular tank cover, it may also be used to cover any circular or oval structure including a building.

FIG. 2 more clearly shows the assembly of the mounting plates 29 on anchor posts 38 embedded into the concrete upstanding side wall 30 and the fitting of an end 37 of radial beam 19 into beam support 18 extending from intermediate ring 12. However, use of the cover supports 27 may be replaced with other types of supports such as corbels located on the tank wall 30 (not shown) thus allowing vertical movement of the cover if required.

Figure 3:
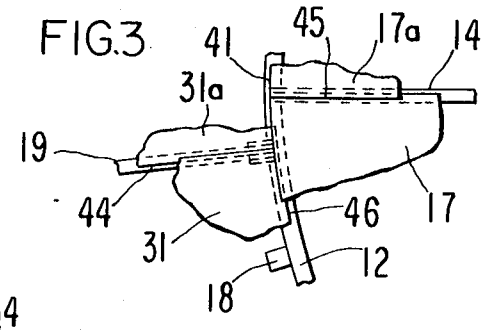
FIG. 3 is a partial cutaway top view of the intersection of an intermediate thrust ring and outer and inner radial beams with an overlay of cover plates.

FIG. 3 is a top view of a typical intersection of cover plates and radial beams with an intermediate thrust ring 12 showing a construction in which the outer radial beams 19 are rotatively displaced from inner radial beams 14. The advantage of this construction is the complete independence of beam quantities between rises. This allows configurations to be used which optimize the amount of steel plate required to form the trapazoidal shaped cover plates. Cover segments 17 and 17*a* are overlapped as at 45. Cover 31*a* seats on the top surface 44 of beam 19. Covers 31 and 17 in adjacent annular rises may also be overlapped as at 46 to compensate for misalignments and to simplify the welding procedures in providing a strong weld seal between all plates and a resultant gas and water-tight cover or dome. Nonoverlapped configurations are also possible but require greater amounts of welding.

Figure 4:
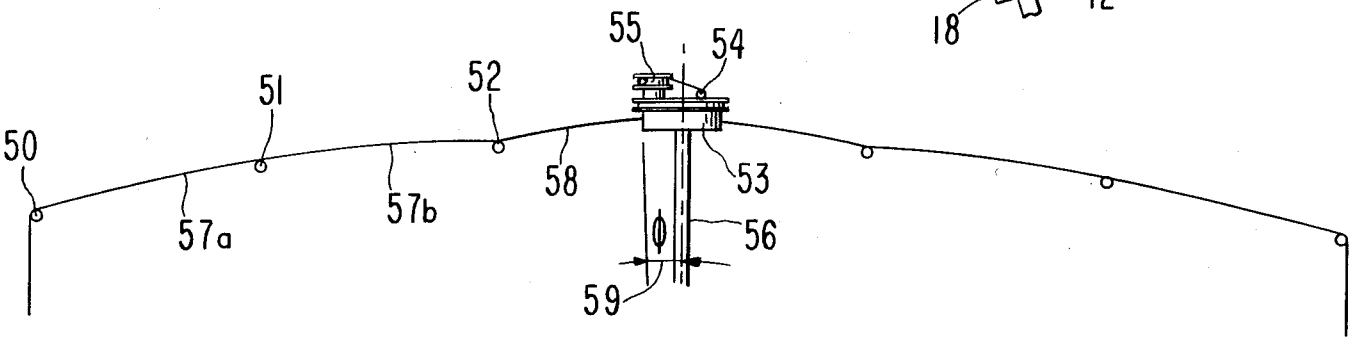
FIG. 4 is a schematic side view of an embodiment showing a multi-rise cover having a decreased radius of curvature in the innermost rise.

FIG. 4 illustrates a multiple three-rise cover having two intermediate thrust rings 51 and 52 concentrically spaced from wall thrust ring 50 and center ring 53. Also in this embodiment, a thickener center-drive mechanism comprising a motor 54 and reducer-drive gear 55 for rotating a center shaft 56 connected to thickener rake arms mounted above the tank bottom for moving settled solids to an exit port (not shown), is provided on top of the center structure 53. In order to compensate for the weight of the drive mechanism or other large load at the center, the radius of curvature of the inner rise 58 is decreased so that the stresses on the cover can be reduced. For example, in a 135-foot diameter thickener tank a cover designed to support a center drive mechanism of 45,000 pounds has an inner rise 58 with a radius of curvature of 70 feet while the outer two rises 57*a* and 57*b* have a 270-foot radius of curvature.

Decreasing the radius of curvature of the inner rise 58 increases the angle $\phi$ at 59 between the outer edge of the center ring and the center of the vertical drive shaft and greatly reduces stress in the cover plates. In alternative configurations rises other than the inner rise may have a different dome radius to compensate, for example, for increases in dome height to accommodate items beneath it. The present invention may be used not only on fixed covers but also on gas holder and bouyant digester covers which are movable up and down in operation and use. The movable covers may be mounted by corbels extending from wall 30 or resting on brackets bolted to the tank wall.

The above description of the advantages of the preferred embodiment of this invention is intended to be illustrative only, and not limiting. Other embodiments of this invention will be apparent to those skilled in the art in view of the above disclosure.

I claim:

1. A cover for an essentially continuous closed upstanding wall comprising:

means for providing a continuous closed first thrust ring supported by said wall;

means for providing a continuous closed second thrust ring internally of and spaced from said first thrust ring;

a first set of radial rise beams extending between said first and second thrust rings at spaced radial locations;

means for connecting a first series of rise cover plates between beams of said first set of beams and between said first and second rings;

means for providing a center ring spaced inwardly from said second thrust ring;

a second set of radial rise beams extending between said second thrust ring and said center ring; and means for connecting a second series of rise cover plates between beams of said second sets of beams between said second thrust ring and said center ring.

2. The invention of claim 1 further including bracket means on said thrust rings extending radially of said rings for receiving the ends of said rise beams and for compensating for any nonconcentricity of said rings and sizing tolerances of said beams.

3. The invention of claim 1 in which said center ring is located centrally of said wall.

4. The invention of claim 1 in which the span between said first, second and center rings are radially curved to form a dome-shaped cover.

5. The invention of claim 4 in which a span between two of said rings has a differing radius of curvature than spans between another two of said rings.

6. The invention of claim 1 further including at least one additional thrust ring spaced between said second thrust ring and said center ring and means for forming additional sets of beams and series of plates between said at least one additional thrust ring and spaced adjoining thrust rings.

7. A method of constructing a cover spanning a generally continuous upstanding side wall comprising:

a. erecting a first continuous thrust ring adjacent to and for connection with respect to said side wall;

b. providing an intermediate continuous thrust ring within and spaced from said first thrust ring;

c. connecting a first set of discrete radial beams in bridging relation between said intermediate thrust ring to said first thrust ring to form a first rise framework;

d. connecting a first series of rise cover plates over the space between adjacent ones of said set of radial beams and the span between said intermediate thrust ring and said first thrust ring to form a first rise;

e. temporarily supporting said intermediate thrust ring as required for spacial assembly;

f. connecting a second set of discrete radial beams between said intermediate thrust ring and a center compression ring;

g. connecting a second series of rise cover plates over the space between adjacent ones of said second set of radial beams and the span between said intermediate thrust ring and said center compression ring; and h. removing the temporary supports such that a resultant cover is entirely supported by said first thrust ring.

8. The invention of claim 1 further including temporarily supporting said center compression ring and said intermediate thrust ring at an elevation higher than said wall and said second rise extends between said center compression ring and said intermediate thrust ring.

9. The invention of claim 1 wherein an assembly of said center compression ring, said intermediate thrust ring, and said second set of radial beams and said second series of rise cover plates are preassembled and including the steps of hoisting the resultant assembly to an elevated center location above said wall and temporarily supporting the assembly thereat and wherein said first set of radial beams and said first series of cover plates are then connected between said elevated intermediate ring of said assembly and said first thrust ring.

10. The invention of claim 1 including temporarily supporting said intermediate thrust ring at an elevation above said wall and said first set of radial beams and first series of cover plates extend from said first thrust ring to said intermediate thrust ring to form said first rise.

11. The invention of claim 1 including providing more than one spaced intermediate thrust rings and repeating steps c, d and e to form intermediate rises between intermediate thrust rings.

12. The invention of claim 1 wherein a rise of one of said set of beams and series of plates has a radial radius of curvature differing than any other rise of one of said set of beams and series of plates.

13. A method of constructing a cover spanning a generally continuous upstanding side wall comprising:

a. erecting a first continuous thrust ring at said side wall for connection therewith;

b. providing an intermediate continuous thrust ring having a diameter less than the diameter of said first thrust ring;

c. providing a center compression ring;

d. temporarily supporting said intermediate thrust ring and center ring in a spacial position inward of said first thrust ring;

e. connecting a first series of radial rise beams between spaced radial positions on said first thrust ring and said intermediate thrust ring, spaced inwardly from said first thrust ring;

f. connecting a first series of rise cover plates over said first series of rise beams and sections of said first thrust ring and said intermediate thrust ring to form an outer rise;

g. connecting a second series of radial rise beams between spaced radial positions on said intermediate thrust ring and said center ring;

h. connecting a second series of rise cover plates over said second series of rise beams and sections of said intermediate thrust ring and center ring to form an inner rise; and i. removing the temporary support of said center ring and intermediate thrust ring.

14. The invention of claim 13 further including providing and temporarily supporting at least one additional intermediate thrust ring; after step f. connecting additional series of rise beams between said intermediate thrust ring and said additional intermediate thrust ring and connecting an additional series of rise plates over said additional series of rise beams; and wherein said intermediate thrust ring in steps g. and h. is said additional thrust ring.

15. The invention of claim 13 in which said rise beams and rise plates are curved so as to provide a curved cover raising from said side wall to said center ring and encompassed by said continuous side wall.

16. The invention of claim 15 in which the radius of curvature of one of said rise beams and series of plates differs from the radius of curvature of any other of said rise beams and series of plates.

17. The invention of claim 13 in which said first series of radial rise beams are rotatively offset from the said second series of rise beams.

18. The invention of claim 13 in which said connecting steps comprise welding the rise beams to the first and intermediate thrust rings and welding the rise plates to the first and intermediate thrust rings and rise beams.

19. The invention of claim 13 further including overlapping adjacent rise plates at a position above their adjacent rise beams and said first thrust ring sections and sealing the outer peripheral edge portions of said second series of rise plates to form a water-tight cover.

20. The invention of claim 13 in which said continuous side wall is circular and said center ring is positioned at the center of radius of said continuous side wall.

* * * * *

UNITED STATES PATENT AND TRADEMARK OFFICE

CERTIFICATE OF CORRECTION

PATENT NO. : 4,541,210

DATED : September 17, 1985

INVENTOR(S) : Cook

It is certified that error appears in the above—identified patent and that said Letters Patent is hereby corrected as shown below:

Col. 7, line 12, change "1" to --7--.

Col. 7, line 17, change "1" to --7--.

Col. 7, line 26, between "mediate" and "ring" insert --thrust--.

Col. 7, line 27, change "1" to --7--.

Col. 7, line 33, change "1" to --7--.

Col. 7, line 37, change "1" to --7--.

Col. 8, line 20, following "f." insert a comma.

Signed and Sealed this

*Fourth* Day of *March 1986*

[SEAL]

*Attest:*

DONALD J. QUIGG

*Attesting Officer*

*Commissioner of Patents and Trademarks*